US011795678B1

(12) United States Patent
Zhang

(10) Patent No.: US 11,795,678 B1
(45) Date of Patent: Oct. 24, 2023

(54) SPECIAL URINAL, SQUATTING PAN AND PEDESTAL PAN

(71) Applicant: BAOMA YIXUAN ELECTRONIC COMMERCE (TIANJIN) CO., LTD., Tianjin (CN)

(72) Inventor: Haichao Zhang, Baoding (CN)

(73) Assignee: BAOMA YIXUAN ELECTRONIC COMMERCE (TIANJIN) CO., LTD., Tianjin (CN)

( * ) Notice: Subject to any disclaimer, the term of this patent is extended or adjusted under 35 U.S.C. 154(b) by 0 days.

(21) Appl. No.: 18/329,572

(22) Filed: Jun. 5, 2023

Related U.S. Application Data

(63) Continuation of application No. PCT/CN2022/072691, filed on Jan. 19, 2022.

(30) Foreign Application Priority Data

Jan. 20, 2021 (CN) ..... 202110077314.1
Jan. 20, 2021 (CN) ..... 202120152235.8
Sep. 27, 2021 (CN) ..... 202122348779.4

(51) Int. Cl.
*E03D 13/00* (2006.01)

(52) U.S. Cl.
CPC ..... *E03D 13/002* (2013.01)

(58) Field of Classification Search
CPC ..... E03D 13/002
(Continued)

(56) References Cited

U.S. PATENT DOCUMENTS 6,370,705 B1 4/2002 Levinson
2015/0275494 A1 10/2015 Kashirajima et al.

FOREIGN PATENT DOCUMENTS

CN 2526370 Y 12/2002
CN 2557612 Y 6/2003
(Continued)

OTHER PUBLICATIONS

International Search Report in PCT/CN2022/072691 dated Apr. 12, 2022, 8 pages.
(Continued)

*Primary Examiner* — Christine J Skubinna
(74) *Attorney, Agent, or Firm* — METIS IP LLC

(57) ABSTRACT

The present disclosure relates to the technical field of daily necessities, and provides a urinal, a squatting pan and a pedestal pan. The special urinal comprises a urinal, a sewage discharge port, a water inlet and a water outlet hole. The urinal has a first end adjacent to the sewage discharge port and a second end away from the sewage discharge port; the sewage discharge port is provided at the bottom of the urinal, the water outlet hole is communicated with the water inlet, the urinal is internally provided with a protruding portion that is used for being opposite to the anus of a user; one end of the protruding portion extends to the bottom of the urinal; and the water outlet hole is used for flushing the protruding portion. The present disclosure aims to solve the defect in the prior art that a female urinal cannot distinguish stool from urine. By providing the protruding portion, in the case of conforming to women's toileting habits, a stool avoidance function is achieved, and a user is prevented from defecating, thus achieving the purpose of women's urination. By using the special urinal, a female public lavatory can be provided with a stool area and a urine area, thus improving the overall toileting efficiency, reducing the number of people in a queue, and shortening the queuing and waiting time.

10 Claims, 4 Drawing Sheets

(58) Field of Classification Search
USPC ..... 4/301
See application file for complete search history.

(56) References Cited

FOREIGN PATENT DOCUMENTS

| | | | |
|---|---|---|---|
| CN | 100427017 | C | 10/2008 |
| CN | 101684665 | A | 3/2010 |
| CN | 201746921 | U | 2/2011 |
| CN | 202194218 | U | 4/2012 |
| CN | 202194229 | U | 4/2012 |
| CN | 204001125 | U | 12/2014 |
| CN | 212294944 | U | 1/2021 |
| CN | 112761229 | A | 5/2021 |
| CN | 213608149 | U | 7/2021 |
| CN | 113456178 | A | 10/2021 |
| CN | 307036713 | S | 12/2021 |
| CN | 307066870 | S | 1/2022 |
| TW | 309946 | U | 7/1997 |
| TW | M423132 | U | 2/2012 |
| TW | M629399 | U | 7/2022 |

OTHER PUBLICATIONS

Written Opinion in PCT/CN2022/072691 dated Apr. 12, 2022, 9 pages.

SPECIAL URINAL, SQUATTING PAN AND PEDESTAL PAN

CROSS-REFERENCE TO RELATED APPLICATIONS

This application is a continuation of International Application No. PCT/CN2022/072691, filed on Jan. 19, 2022, which claims the priority of Chinese patent application No. 202110077314.1 entitled "special urinal for women, squatting pan and pedestal pan" filed on Jan. 20, 2021, Chinese patent application No. 202120152235.8 entitled "a protruding device in special urinal for women" filed on Jan. 20, 2021 and Chinese patent application No. 202122348779.4 entitled "special pedestal pan for women's urination" filed on Sep. 27, 2021. All of the contents of the above applications are incorporated into this application by reference in their entirety.

TECHNICAL FIELD

The present disclosure relates to the technical field of daily necessities, in particular to a special urinal, a squatting pan and a pedestal pan.

BACKGROUND

The female public lavatory always have a bad reputation, because women often have to wait in line for a long time when there are a lot of people going to the public lavatory. Compared with men, the female public lavatory does not have urinals for urinating, and the number of lavatory is limited, so it is easy to queue up in the female public lavatory. Especially under the condition of short-term large crowds such as concerts, theaters, scenic spots during holidays, etc. there is an upper toilet demand, the problem will become more serious.

There is an independent urinal, and the demand for urine and stool is treated differently. If it can be like a male public lavatory, it can improve the queuing efficiency with only urine demand and optimize the use process of a female public lavatory. In general, the frequency of urinating is much higher than that of stool, and the time spent urinating is far less than that of stool. Therefore, when people queue up in women's public lavatory, the number of people who only need to urinate is far greater than the number of people who stool.

At present, in the western society, the existing women's urinals are mounted in a suspended mode, and users urinate in a ski-like posture, and their bodies are in contact with the urinals all the time. This is a posture that is typically employed in a conventional public toilet lavatory based on the female fear of fear of dirty and undesirable body contact; there are also female users who use hand-held female urination devices to achieve standing urination.

In the patent of CN1293729A, there is provided a urinal for women, which comprises a body having a connecting portion attached to a support, a receiving portion located at the end far away from the support for receiving women's urine, and a narrower portion located between them and narrower than the receiving portion. Using this urinal, women substantially employ a ski-type semi-squatting posture, or a male-like cross-standing posture.

In the patent of ZL200410090240.1, a diversion device for people to urinate in standing posture or sitting posture is provided. In particular with respect to such a urine diversion device, it is characterized in that its diversion device is in the shape of a groove, the end is urine receiving, and a flow guide is provided on the diversion device. The height of the bottom end of the urine receiving port of the diversion device is higher than the bottom of the diversion device, and the urine receiving port is inclined. When women use it, a male cross-vertical posture is similar, one hand can fix the trousers, and the other hand places the paper sheet on the portion which connects the thigh and the vulva. The body is slightly inclined forwards.

Although the above-mentioned existing methods have realized the function of urine of women, the existing urinating posture (pedestal pan or full squat) of women is changed. Due to female physiological structures, these techniques have been repelled by most women and have low popularity. The present invention is mainly applied to emergency occasions. Mainly used in emergency situations or small crowds. Moreover, according to research and investigation, there is no special urinal in men's lavatory in the middle-east region, which affects the efficiency of the toilet.

SUMMARY

The present disclosure provides a special urinal, squatting pan and pedestal pan which are used for solving the defect that in the prior art, a woman's urinal cannot distinguish between stool and urine, thereby achieving the special purpose of women's urination, improving the overall toilet efficiency of women in public lavatory, reduce the number of people queuing for urination, and shorten the time for urination.

The present disclosure provides a special urinal, comprising: a urinal, a sewage discharge port, a water inlet and a water outlet hole; the urinal has a first end adjacent to the sewage discharge port and a second end away from the sewage discharge port; the sewage discharge port is provided at the bottom of the urinal, the water outlet hole is communicated with the water inlet, the urinal is internally provided with a protruding portion that is used for being opposite to the anus of a user, one end of the protruding portion extends to the bottom of the urinal, the water outlet hole is used for flushing the protruding portion.

The present disclosure provides a special urinal, wherein the protruding portion has a first end adjacent to the sewage discharge port and a second end adjacent to the water outlet hole. The height of the first end of the protruding portion is lower than or equal to the height of the second end.

The present disclosure provides a special urinal, wherein the middle part of the first end of the protruding portion is provided with a concave first avoidance zone, and the opening of the first avoidance zone faces the sewage discharge port.

The present disclosure provides a special urinal, wherein the first end of the protruding portion is also provided with a concave second avoidance zone, the second avoidance zone is located at the left and right sides of the first avoidance zone.

The present disclosure provides a special urinal, wherein the protruding portion is provided with a diversion part, the diversion part is used to divert flushing water.

The present disclosure provides a special urinal, wherein the diversion part is arranged along the direction from the water outlet hole adapted to the protruding portion to the sewage discharge port.

The present disclosure provides a squatting pan which comprises the special urinal, wherein the first end of the urinal is provided with a urine baffle.

The present disclosure provides a pedestal pan which comprises the special urinal, wherein the urinal has a urine retaining end at the first end and an open groove at the second end; the open groove penetrates through the inner side and the outer side of the urinal.

The present disclosure provides a pedestal pan, wherein the top side of the urinal is provided with a seat ring, and one end of the seat ring corresponding to the open groove is provided with an opening corresponding to the open groove.

The present disclosure provides a pedestal pan, wherein the bottom of the opening grooves is flush with the second end of the protruding portion.

The present disclosure provides a urinal, a squatting pan and a pedestal pan. The special urinal comprises a urinal, a sewage discharge port, a water inlet and a water outlet hole. The urinal has a first end adjacent to the sewage discharge port and a second end away from the sewage discharge port; the sewage discharge port is provided at the bottom of the urinal, the water outlet hole is communicated with the water inlet, the urinal is internally provided with a protruding portion that is used for being opposite to the anus of a user; one end of the protruding portion extends to the bottom of the urinal; and the water outlet hole is used for flushing the protruding portion. The present disclosure aims to solve the defect in the prior art that a female urinal cannot distinguish stool from urine. By providing the protruding portion, in the case of conforming to women's toileting habits, a stool avoidance function is achieved, and a user is prevented from defecating, thus achieving the purpose of women's urination. By using the special urinal, a female public lavatory can be provided with a stool area and a urine area, thus improving the overall toileting efficiency, reducing the number of people in a queue, and shortening the queuing and waiting time.

BRIEF DESCRIPTION OF THE DRAWINGS

As shown in FIG. 1, FIG. 2, FIG. 3 and FIG. 4, a special urinal according to an embodiment of the present disclosure comprises the urinal 100, the drain outlet 110, the water inlet 120, the water outlet 121, the protruding portion 130, the flow guide portion 131, the first avoidance area 132, the second avoidance area 140, the seat ring 160, the open groove 170, the urine baffle 180.

DETAILED DESCRIPTION

In order to more clearly illustrate the objectives, technical solutions and advantages of the present disclosure, the technical solutions in the present disclosure will be clearly and completely described in further detail hereinafter with reference to the drawings in the present disclosure, and obviously, the described embodiments are some embodiments of the present disclosure, rather than all embodiments. Those having ordinary skills in the art, without further creative efforts, may apply the present disclosure to other similar scenarios according to these drawings. It should be understood that these exemplary embodiments are given only to enable those skilled in the art to better understand and realize the invention, and not intend to limit the scope of the present disclosure in any way.

Figure 1:
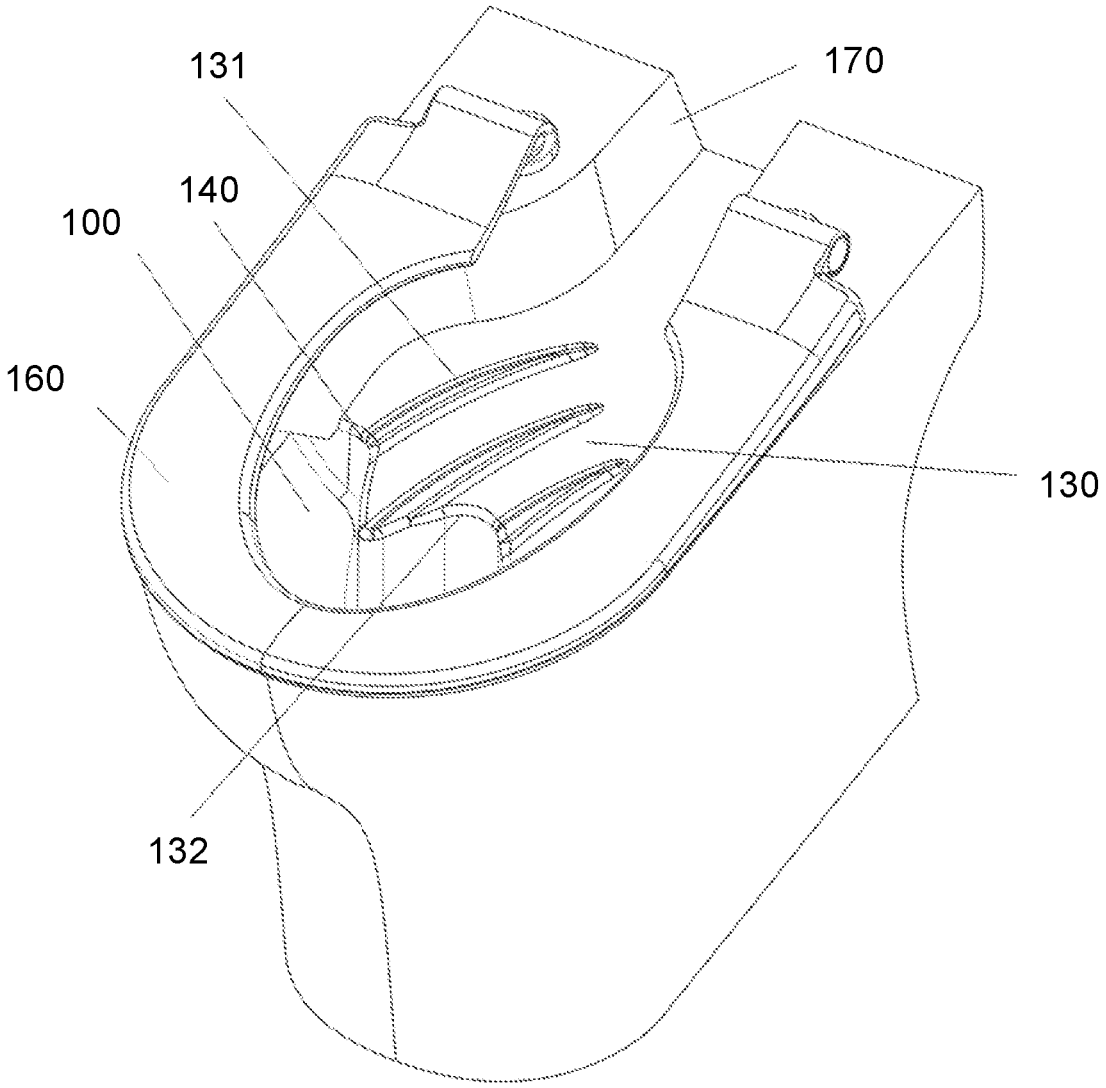
FIG. 1 is a first schematic view showing a structure of a pedestal pan according to an embodiment of the present disclosure.
Figure 2:
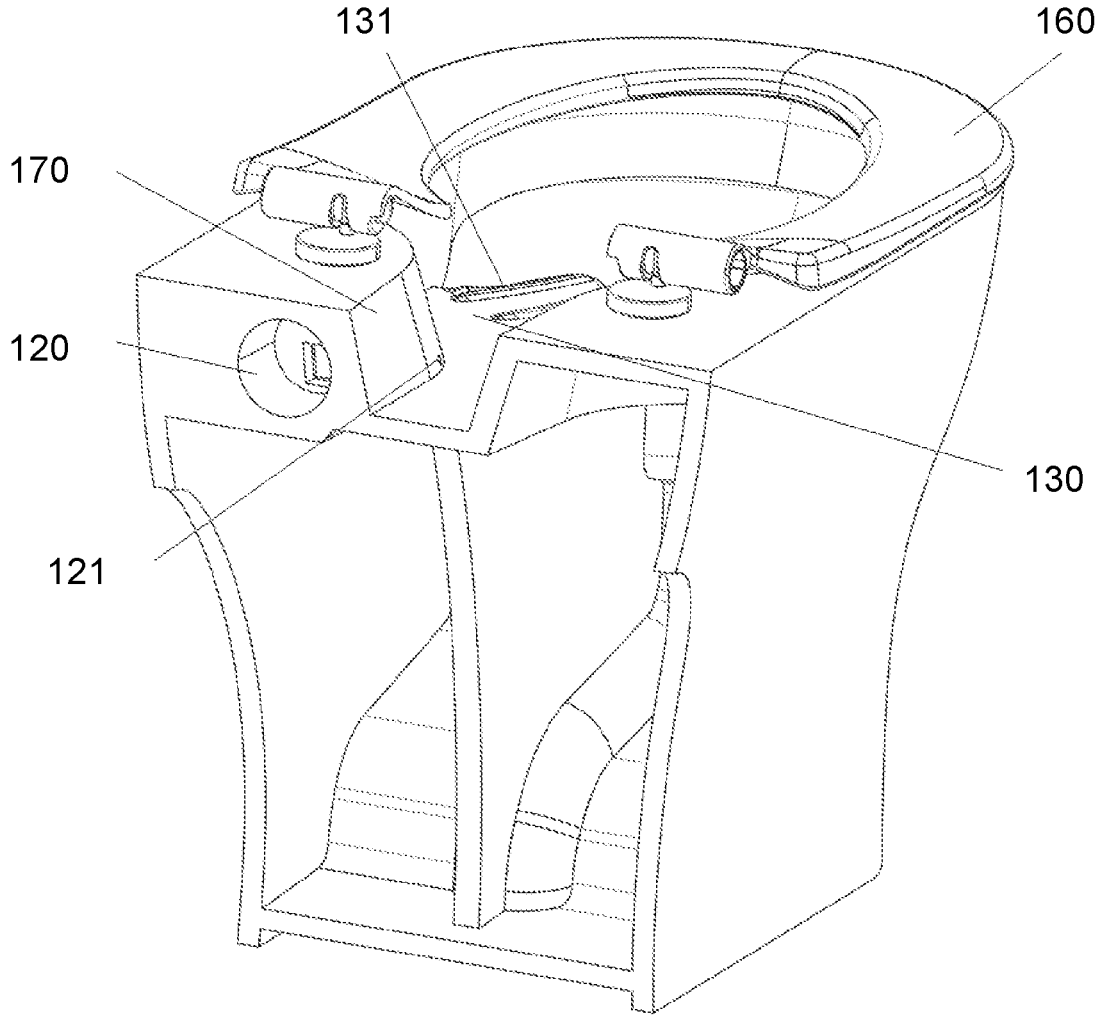
FIG. 2 is a second schematic view showing a structure of a pedestal pan according to an embodiment of the present disclosure.
Figure 3:
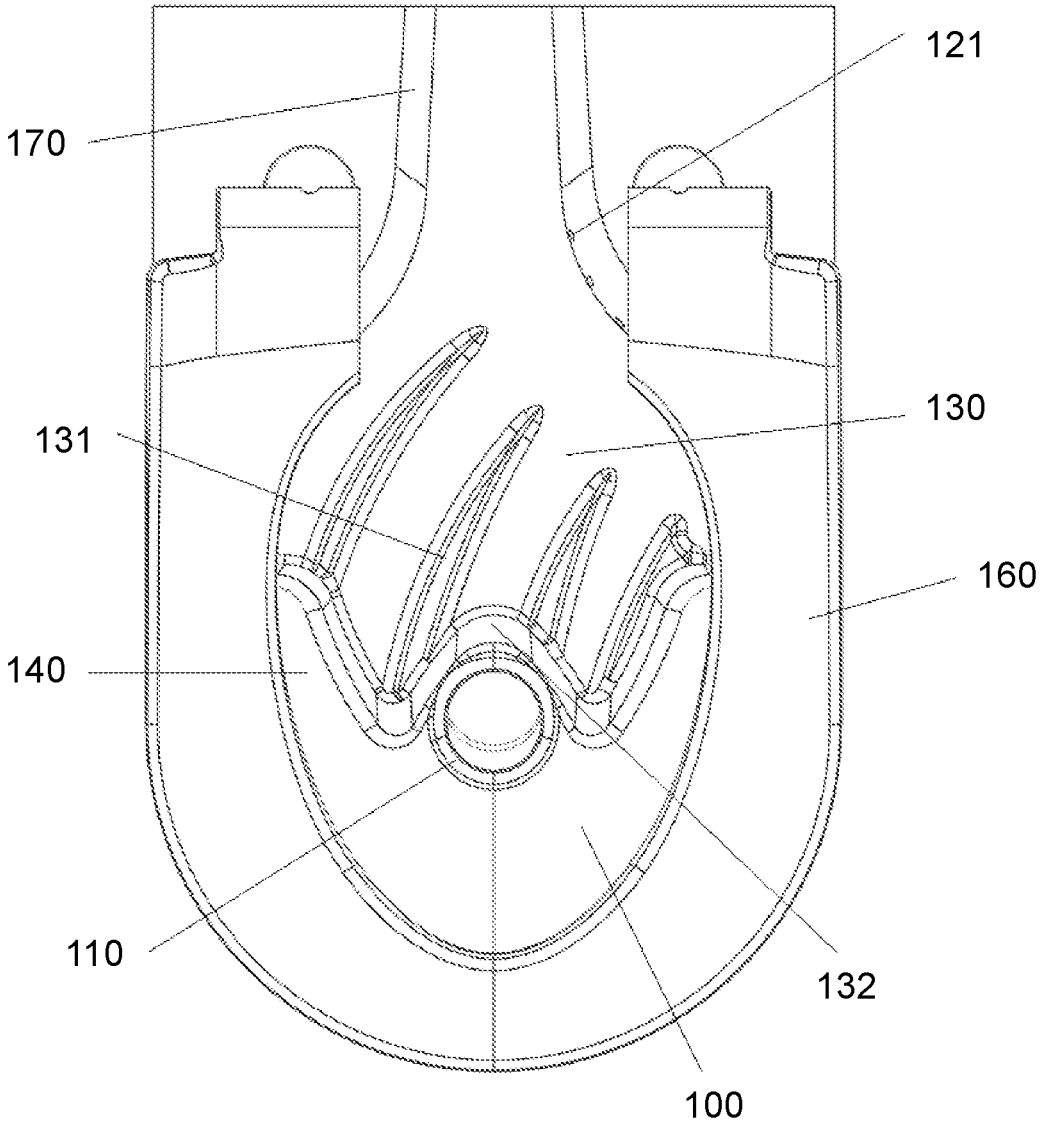
FIG. 3 is a top view of a pedestal pan according to an embodiment of the present disclosure.
Figure 4:
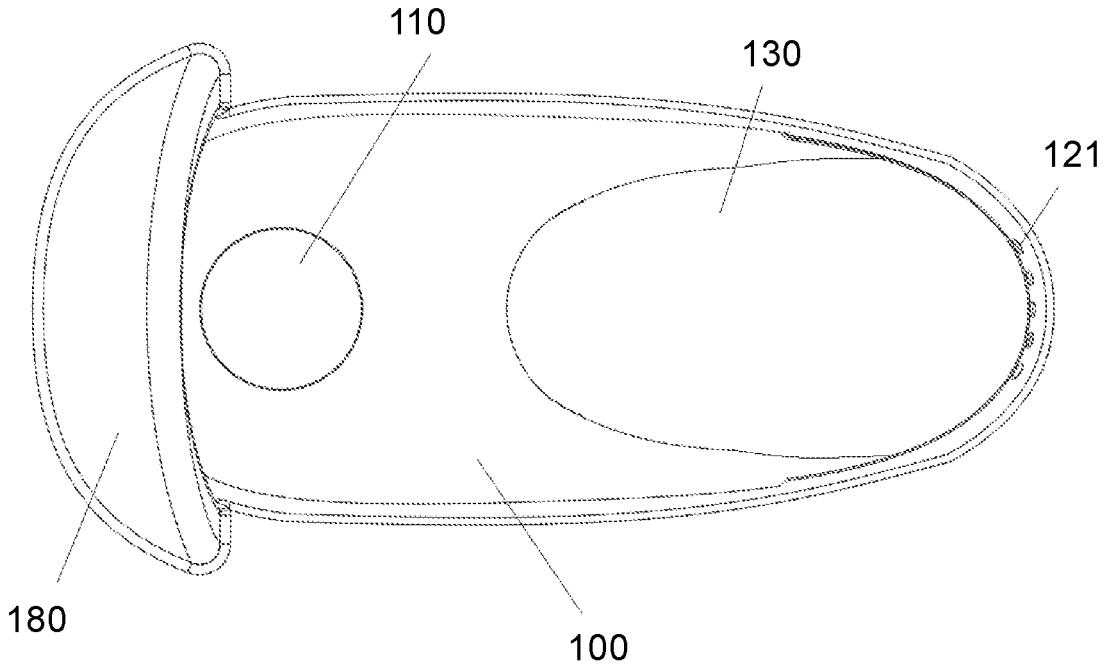
FIG. 4 is a first schematic view showing a structure of a squatting pan according to an embodiment of the present disclosure.

As shown in FIG. 1, FIG. 2, FIG. 3 and FIG. 4, a special urinal according to the present disclosure comprises a urinal 100, a sewage discharge port 110, a water inlet 120 and a water outlet hole 121; the urinal 100 has a first end adjacent to the sewage discharge port 110 and a second end away from the sewage discharge port 110; the sewage discharge port 110 is provided at the bottom of the urinal 100, the water outlet hole 121 is communicated with the water inlet 120, the urinal 100 is internally provided with a protruding portion 130 that is used for being opposite to the anus of a user, one end of the protruding portion 130 extends to the bottom of the urinal 100, the water outlet hole 121 is used for flushing the protruding portion 130. It can be understood that the sewage discharge port 110 is provided at the bottom of the first end of the urinal 100 for timely discharging the urine and flushing water out of the urinal 100. The water inlet 120 is disposed at the second end of the urinal 100, the water inlet 120 and the sewage discharge port 110 are located at two opposite ends of the urinal 100, and the water inlet 120 is connected to a water source to provide flushing water for the urinal 100. In this embodiment, the water guide ring is arranged on the inner side wall of the urinal 100 and is communicated with the water inlet 120, so that the water entering the water inlet 120 is guided. The water guide ring is provided with a plurality of water outlet holes 121, and the plurality of water outlet holes 121 face the interior of the urinal 100 for flushing the urinal 100 from a plurality of angles. In this embodiment, the plurality of water outlet holes 121 are uniformly arranged along the horizontal circumferential direction of the second end of the urinal 100, so that multi-angle flushing coverage in the urinal 100 is ensured, and the flushing effect and efficiency are improved.

Further, the protruding portion 130 is provided in the urinal 100, and the protruding portion 130 is located at a position close to the second end of the urinal 100. The protruding portion 130 is opposite to the anus of the user, so that the distance between the anus of the user and the bottom of the urinal 100 is reduced, that is, it does not create conditions for the user to defecate, and at the same time, it does not affect the user's urination, thus achieving the purpose of urinating exclusively. It should also be noted that, on the other hand, the arrangement of the protruding portion 130 may increase the risk that the stool will contact with the user's body or clothes, thereby affecting the user's defecation and achieving the exclusive use of urine. Moreover, the arrangement of the protruding portion 130 does not affect the direction of the urinal 100 from the second end to the first end of the urinal 100 into the urinal 100, so that the urinal 100 retains the function of urinating and realizes the exclusive use of urine.

One end of the protruding portion 130 extends to the bottom of the urinal 100 to achieve a certain diversion effect on urine. In this embodiment, one end of the protruding portion 130 is fixedly connected to the bottom of the urinal 100, so that the protruding portion 130 is mounted in the urinal 100. Alternatively, the other end of the protruding portion 130 is fixedly connected to the inner side wall of the second end of the urinal 100, so as to achieve the mounting of the protruding portion 130.

Further, the water outlet hole 121 is used for flushing the protruding portion 130, that is to say, the water flow flowing out of the water outlet hole 121 passes through the upper surface of the protruding portion 130 to flush the upper surface of the protruding portion 130, thereby ensuring the cleanliness of the protruding portion 130.

In one embodiment, the sewage discharge port 110 is provided with a filter screen to prevent the foreign matter from entering the sewage discharge port 110 to cause blockage.

According to the special urinal provided by the present disclosure, the protruding portion 130 has a first end adjacent to the sewage discharge port 110 and a second end adjacent to the water outlet hole 121; and the height of the first end of the protruding portion 130 is lower than or equal to the height of the second end. It may be understood that the protruding portion 130 is horizontally disposed or obliquely disposed downward in the length direction of the urinal 100 in a direction from the water outlet hole 121 corresponding to the protrusion portion of the urinal 100 to the sewage discharge port 110. The upper surface of the protruding portion 130 may be configured to be horizontal, or may be configured to be inclined in the length and depth direction of the urinal 100, so as to achieve a diversion effect on urine and flushing water.

According to the special urinal pool provided by the present disclosure, the middle portion of the first end of the protruding portion 130 is provided with a concave first avoidance zone 132, and the opening of the first avoidance zone 132 faces the sewage discharge port 110, and it can be understood that a concave avoidance area 132 is provided in the middle of the side of the protruding portion 130 facing the sewage discharge port 110, so that urine is prevented from directly impacting the protruding portion 130, so that the urine flows into the urinal 100 from the avoidance area 132.

According to the special urinal provided by the present disclosure, the first end of the protruding portion 130 is further provided with a concave second avoidance area 140, and the second avoidance area 140 is located on the left and right sides of the first avoidance area 132. It can be understood that more concave second avoidance areas 140 are provided on two sides of the urinal 100, so that urine on the two sides is prevented from directly impacting the protruding portion 130, so that the urine flows into the urinal 100 from the second avoidance area 140.

It should be noted that, in one embodiment, the orthographic projection of the upper surface of the protruding portion 130 is W-shaped.

According to the special urinal provided by the present disclosure, the protruding portion 130 is provided with a diversion part 131, and the diversion part 131 is used for guiding flushing water. It can be understood that the diversion part 131 is disposed on the upper surface of the protruding portion 130 in a direction from the water outlet hole 121 adapted to the protruding portion 130 to the sewage discharge port 110, so that the flushing water flow flowing out of the water outlet hole 121 flows through the diversion part 131 to cover the entire protrusion portion 130, and is guided into the urinal 100 while flushing the upper surface of the protruding portion 130, and is discharged from the sewage outlet 110.

It should be noted that, the diversion part 131 may be configured as a flow guide strip, a flow guide groove, a flow guide table or a flow guide plate, etc. so as to achieve a flow guide effect on flushing water.

The present disclosure further provides a squatting pan, comprising the special urine pool as described above, wherein the first end of the urinal 100 is provided with the urine baffle 180, and it can be understood that the squatting pan comprises a special urine pool, and the urine baffle 180 is provided at the first end of the urinal 100 to block the urine and prevent it from spraying out of the urinal 100. The height of the urine baffle 180 is higher than the height of the urinal 100.

In one embodiment, the top side of the urinal 100 is provided with an outwardly extending pedal, which is convenient for a user to squat, and at the same time, the pedal is provided with an anti-skid groove to prevent the user from slipping and falling. The anti-skid groove can also play a positioning indication to guide the user to step on the anti-skid groove and use the squatting pan.

It should be noted that the anti-skid groove may also be configured as an anti-skid protrusion, increasing the friction force between the user's foot and the pedal, and improving the safety of the lavatory.

The present disclosure further provides a pedestal pan, comprising the special urine as described above, wherein a first end of the urinal 100 is provided with a urine blocking end, and a second end of the urinal 100 is provided with an open slot 170; and the open slot 170 penetrates the inner and outer sides of the urinal 100. It can be understood that the urinal 100 is provided with a urine blocking end and an opening groove 170 which are oppositely arranged, that is, the first end of the urinal 100 is provided with a urine blocking end to block urine; the second end of the urinal 100 is provided with an open groove 170, and the open groove 170 is connected to the end of the second end of the protruding portion 130 adjacent to the water outlet hole 121, so that the protruding portion 130 is fixedly assembled in the urinal 100. The opening groove 170 is provided with an opening, and the opening penetrates through the side wall of the second end of the urinal 100 in the length direction of the urinal 100. The urinal 100 does not have a condition for placing feces. The protruding portion 130 is located at the open slot of the urinal 100 to effectively reduce the distance between the anus of the user and the bottom wall of the urinal 100.

If the user forcibly defecates, it will cause the stool to contact with the user's buttocks, or it will be difficult to clean, making the lavatory environment unsuitable for using or sticking the user's clothes or body. That is to say, the user only uses the urinal 100 to urinate and go to the lavatory when he sees that the urinal 100 does not have the function of defecating. Due to the urine discharge direction of the urinal 100 is from the open slot of the urinal 100 to the urine blocking end, the protruding portion 130 and the open slot will not affect the urination function of the urinal 100, thereby achieving the exclusive use of urine for women, improving the overall lavatory efficiency and reducing the waiting time for urination in the public lavatory.

In this embodiment, the width of the open slot 170 is 4 cm to 14 cm along the width direction of the urinal 100.

According to the lavatory provided by the present disclosure, a seat ring 160 is provided on the top side of the urinal 100, and an opening corresponding to the opening groove 170 is provided at one end of the seat ring 160 corresponding to the opening groove 170. It can be understood that the seat ring 160 is located on the top side of the urinal 100, so as to facilitate the user to sit in the lavatory. One end of the seat ring 160 is provided with an opening, and the end of the seat ring 160 is hinged to the top side of the urinal 100. The opening of the seat ring 160 is disposed vertically corresponding to the open slot of the urinal 100. The contour of the seat ring 160 matches the contour of the top side of the urinal 100, so as to ensure the stability and comfort of the user in the process of sitting.

According to the lavatory provided by the present disclosure, the seat ring 160 is provided with a limiting protrusion, and the limiting protrusion is disposed opposite to the opening of the seat ring 160. It can be understood that the limiting protrusion is arranged on the upper side of the front end of the seat ring 160, so that the user is prevented from moving forwards to avoid the protruding portion 130, that is, by limiting the position of the user's hip, the specificity of the urinal 100 is enhanced, and the user is prevented from moving the hip to escape the protruding portion 130.

It should be noted that the limiting protrusion may be configured as an arc-shaped protrusion, and the contour of the arc-shaped protrusion is adapted to the leg of the user, thereby increasing the comfort of the user. A limiting plate can also be adopted, the limiting plate is of a plate-shaped structure and is arranged at the front end of the seat ring 160, and the two sides of the limiting plate are arranged to the arc-shaped contours matched with the legs of the user respectively.

According to the lavatory provided by the present disclosure, the bottom of the open slot 170 is flush with the second end of the protruding portion 130. It can be understood that the open slot 170 and the protruding portion 130 can be smoothly communicated to generate a visual pressure for the user, which does not have the function of defecating; otherwise, it is difficult to clean. Meanwhile, it is ensured that the flushing water flow can smoothly flush the protruding part 130.

Based on the special urinal pool provided by the embodiments of the present disclosure, the female lavatory during a holiday period is counted, six cubicles are provided, 60 people go to the lavatory at the same time, and 12 people defecate and 48 people urinate at the same time. It is assumed that the feces time was 5 minutes and the urine time was 1 minute. The defecation is not distinguished, there are 10 people queuing at each lavatory position, and there are two feces requirements and 8 urinating requirements. All people need to go to the lavatory for 18 minutes; if the cubicle is queued, the number of feces in the team increases by one, three feces requirements and 7 urinating requirements are met, and all people need to go to the lavatory for 22 minutes. This means that there is a person with urinating requirements, and it may also be necessary to wait for 18 minutes or even longer. If defecation and urine are distinguished, there are two feces cubicles and 4 urine cubicles in the lavatory. The four urine cubicles were queued for 48 people, and 48 people can complete urine within 12 minutes. After 12 minutes, the number of queuing people is 7.2 individuals under the condition of distinguishing defecation and urine; and the number of queuing people is 16.7 individuals in the case of not distinguishing defecation and urine. Therefore, defecation and urine are distinguished, and for people who only have urinating requirements, the queuing time can be reduced at least for 6 minutes, and the lavatory efficiency is improved by 33.3%; through distinguishing defecation and urine, the total number of queuing people can be reduced and the overall lavatory efficiency is improved.

It should also be noted that, according to the prior art, for example, "Anorectal Anatomy Physiology" written by Zhang dongming was published and issued by Xi'an: Shanxi Science and Technology Press Publishing in December 1989, in its first chapter section, it is clear that the distance from vagina to anus is 2-3 cm; for another example, the invention patent disclosure No. CN 202110752841.8 discloses a fully automatic vaginal scissors, and it is explicitly recited in paragraph [0002] of the description that the distance from vagina to anus is 2 cm to 3 cm; for another example, the disclosure number is CN 2022084765. 1, the invention discloses a bidet having a baffle structure, and it is explicitly recited in paragraph [0028] of the description that the distance between the two limiting holes 131 is 2 cm to 4 cm, that is, the distance between the vaginal orifice and the anus.

That is, the distance between the female's vaginal orifice (equivalent to the urethral orifice) and the anus is relatively fixed. For ease of explanation, when a user urinates in the lavatory, the side facing the user is the first end of the urinal 100, and the side facing away from the user is the second end of the urinal 100. A person skilled in the art can easily know that the length of the urinal 100 is fixed when the user is going to the lavatory normally, the first end of the urinal 100 plays a role in indirectly limiting the pudendum of the user, and at the same time, since the distance from vagina to anus is relatively fixed, the distance from the position where the pudendum of the user is located to the first end is also basically substantially fixed. The position and size of the protruding portion 130 are set according to this position, so that the protruding portion 130 is adapted to be matched with the anus of a woman when a woman squatting or sitting in different body shapes (including height and fat) can be implemented, so as to adapt to women of different body types.

The urinal comprises a urinal, a sewage discharge port, a water inlet and a water outlet, and the urinal is provided with a first end adjacent to the sewage discharge port and a second end away from the sewage discharge port; the sewage discharge port is provided at the bottom of the urinal, the water outlet hole is communicated with the water inlet. a protruding part is arranged in the urinal, the protruding part is used for being opposite to the anus of a user, one end of the protruding part extends to the bottom of the urinal, and the water outlet hole is used for flushing the protruding part. By providing the protruding portion, in the case of conforming to women's toileting habits, a stool avoidance function is achieved, and a user is prevented from defecating, thus achieving the purpose of women's urination. By using the special urinal, a female public lavatory can be provided with a stool area and a urine area, thus improving the overall toileting efficiency, reducing the number of people in a queue, and shortening the queuing and waiting time.

It should be noted that the above embodiments are merely used to illustrate the technical solutions of the present disclosure, and not to limit it. Although the present disclosure has been described in detail with reference to the foregoing embodiments, it should be understood by those of ordinary skill in the art that they can still modify the technical solutions recited in the foregoing embodiments, or perform equivalent replacement on some of the technical features thereof, and these modifications or substitutions do not make the nature of the corresponding technical solutions separate from the spirit and scope of the technical solutions of the embodiments of the present disclosure.

What is claimed is:

1. A special urinal, comprising: a urinal (100), a sewage discharge port (110), a water inlet (120) and a water outlet hole (121); the urinal (100) has a first end adjacent to the sewage discharge port (110) and a second end away from the sewage discharge port (110); the sewage discharge port (110) is provided at the bottom of the urinal (100), the water outlet hole (121) is communicated with the water inlet (120), the urinal (100) is internally provided with a protruding portion (130) that is used for being opposite to the anus of a user, one end of the protruding portion (130) extends to the bottom of the urinal (100), the water outlet hole (121) is used for flushing the protruding portion (130).

2. The urinal according to claim 1, wherein the protruding portion (130) has a first end adjacent to the sewage discharge port (110) and a second end adjacent to the water outlet hole (121);

the height of the first end of the protruding portion (130) is lower than or equal to the height of the second end.

3. The urinal according to claim 2, wherein the middle part of the first end of the protruding portion (130) is provided with a concave first avoidance zone (132), and the opening of the first avoidance zone (132) faces the sewage discharge port (110).

4. The urinal according to claim 3, wherein the first end of the protruding portion (130) is also provided with a concave second avoidance zone (140), the second avoidance zone (140) is located at the left and right sides of the first avoidance zone (132).

5. The urinal according to claim 1, wherein the protruding portion (130) is provided with a diversion part (131), the diversion part (131) is used to divert flushing water.

6. The urinal according to claim 5, wherein the diversion part (131) is arranged along the direction from the water outlet hole (121) adapted to the protruding portion (130) to the sewage discharge port (110).

7. A squatting pan comprising the special urinal according to claim 1, wherein the first end of the urinal (100) is provided with a urine baffle (180).

8. A pedestal pan comprising the special urinal according to claim 2, wherein the urinal (100) has a urine barrier end at the first end and an open groove (170) at the second end; the open groove (170) penetrates through the inner side and the outer side of the urinal (100).

9. The pedestal pan according to claim 8, wherein the top side of the urinal (100) is provided with a seat ring (160), and one end of the seat ring (160) corresponding to the open groove (170) is provided with an opening corresponding to the open groove (170).

10. The pedestal pan according to claim 8, wherein the bottom of the opening grooves (170) is flush with the second end of the protruding portion (130).

* * * * *